US010950984B1

(12) United States Patent
Kinney et al.

(10) Patent No.: US 10,950,984 B1
(45) Date of Patent: Mar. 16, 2021

(54) CONNECTOR ASSEMBLY HAVING A LOW-IMPEDANCE GROUND CONNECTION

(71) Applicant: Apple Inc., Cupertino, CA (US)

(72) Inventors: Michael A. Kinney, San Francisco, CA (US); Mahmoud R. Amini, Sunnyvale, CA (US); Rui Zhou, Sunnyvale, CA (US); Brock A. Zekany, Cupertino, CA (US)

(73) Assignee: Apple Inc., Cupertino, CA (US)

( * ) Notice: Subject to any disclaimer, the term of this patent is extended or adjusted under 35 U.S.C. 154(b) by 0 days.

(21) Appl. No.: 16/586,714

(22) Filed: Sep. 27, 2019

(51) Int. Cl.

| | |
|---|---|
| ***H01R 13/6591*** | (2011.01) |
| ***H01R 33/94*** | (2006.01) |
| ***H01R 13/518*** | (2006.01) |
| ***H01R 33/945*** | (2006.01) |
| ***H01R 33/74*** | (2006.01) |

(52) U.S. Cl.
CPC ..... *H01R 13/6591* (2013.01); *H01R 13/518* (2013.01); *H01R 33/94* (2013.01); *H01R 33/74* (2013.01); *H01R 33/945* (2013.01)

(58) Field of Classification Search
CPC .... H01R 13/6581–6584; H01R 13/659; H01R 13/6591; H01R 13/518; H01R 33/94; H01R 33/945; H01R 33/74
USPC ..... 439/607.17, 607.19, 607.25, 607.26
See application file for complete search history.

(56) References Cited

U.S. PATENT DOCUMENTS 5,399,105 A * 3/1995 Kaufman ..... H01R 13/6582 439/607.19
6,699,071 B1 * 3/2004 Hyland ..... H01R 13/659 439/607.19
8,657,628 B2 * 2/2014 Xie ..... H01R 13/6583 439/607.1
9,153,925 B2 * 10/2015 Golko ..... H01R 43/205
10,403,996 B2 * 9/2019 Pan ..... H01M 2/30
2007/0212942 A1 * 9/2007 Long ..... G02B 6/4256 439/607.17
2008/0171468 A1 * 7/2008 Briant ..... H01R 13/658 439/607.17
2009/0011646 A1 * 1/2009 Yamaji ..... H01R 13/6585 439/607.17
2009/0023339 A1 * 1/2009 Kameyama ..... H01R 13/6583 439/607.17

(Continued)

OTHER PUBLICATIONS

U.S. Application, filed Sep. 10, 2018 as U.S. Appl. No. 16/126,830 in 23 pages.

*Primary Examiner* — Gary F Paumen
(74) *Attorney, Agent, or Firm* — Kilpatrick Townsend and Stockton, LLP

(57) ABSTRACT

An accessory for an electronic device includes a plug connector that is configured to connect to an electronic device when the electronic device is received by the accessory. The accessory also includes a receptacle connector at an exterior surface for coupling the accessory to a charging system when a mating connector is received within a receiving cavity of the receptacle connector. A bracket electrically and mechanically couples the plug connector to the receptacle connector. A ground spring is coupled to an exterior metallic shell of the receptacle connector and has a pair of spring arms that each have a distal end positioned within the receiving cavity such that when a mating plug connector is received within the receiving cavity a low-impedance ground path is formed between the mating connector and the plug connector.

20 Claims, 4 Drawing Sheets

(56) References Cited

U.S. PATENT DOCUMENTS

2015/0093936 A1* 4/2015 Little ..... H01R 13/6583
439/607.19
2020/0083051 A1* 3/2020 Wang ..... H01L 21/823842

* cited by examiner

CONNECTOR ASSEMBLY HAVING A LOW-IMPEDANCE GROUND CONNECTION

FIELD

The described embodiments relate generally to connector assemblies for electronic devices. More particularly, the present embodiments relate to an accessory that includes two connectors that are positioned at an external surface of an electronic accessory and an assembly that provides a low-impedance to ground between the connectors to improve electromagnetic compatibility (EMC) performance of the accessory.

BACKGROUND

A wide variety of electronic devices are available for consumers today and are expected to operate in an ever increasingly "noisy" electronic environment. More specifically, with the increasing electromagnetic interference generated by the growing number of electronic devices and wireless features, electronic devices must meet demanding electromagnetic compatibility (EMC) requirements. EMC requirements may include both regulating electromagnetic emissions from the electronic device and electromagnetic susceptibility of the electronic device to emissions from other devices.

Many of these electronic devices have a plurality of external electronic connectors that facilitate communication with and/or charging of a corresponding device. A reduced ground impedance between the external electronic connectors can improve EMC performance of the electronic device. New electronic connector assemblies that reduce the ground impedance between connectors are needed.

SUMMARY

In some embodiments a connector assembly comprises a first connector having an exterior metallic shell and a receiving cavity sized to receive a plug portion of a mating connector. A second connector has an exterior metallic body and a bracket electrically and mechanically couples the exterior metallic shell to the exterior metallic body. A ground spring is coupled to the exterior metallic shell and has at least one spring arm with a distal end that is positioned within the receiving cavity. In various embodiments the distal end is positioned to contact the plug portion of the mating connector when the plug portion is received within the receiving cavity.

In some embodiments a ground path is formed between the second connector and the plug portion of the mating connector via the ground spring and the bracket. In various embodiments the ground spring is welded to the exterior metallic shell and welded to the bracket. In some embodiments the bracket is welded to the exterior metallic body. In various embodiments the ground spring includes a pair of spring arms, each having a distal end that protrudes through a corresponding aperture defined by the first connector. In some embodiments the second connector is a tab connector.

In some embodiments a connector assembly comprises a receptacle connector having an insulative enclosure and an exterior metallic shell formed at least partially around an exterior of the enclosure, the enclosure defining a receiving cavity sized to receive a plug portion of a mating connector. A bracket is coupled to the exterior metallic shell and a ground spring is positioned between the exterior metallic shell and the bracket, the ground spring having at least one spring arm with a distal end that protrudes through an aperture defined by the enclosure such that the distal end is positioned within the receiving cavity.

In some embodiments a plug connector having an exterior metallic body that is attached to the bracket. In various embodiments the plug connector includes a pair of transverse extensions that are laser welded to the bracket. In some embodiments the distal end of the at least one spring arm is positioned to contact the plug portion of the mating connector when the plug portion is received within the receiving cavity. In various embodiments a ground path is formed between the plug connector and the plug portion of the mating connector via the ground spring and the bracket.

In some embodiments the ground spring is welded to the exterior metallic shell and welded to the bracket. In various embodiments the bracket is welded to an exterior metallic body of a plug connector. In some embodiments the ground spring includes a pair of spring arms, each having a distal end that protrudes through a corresponding aperture defined by the enclosure.

In some embodiments an accessory for an electronic device comprises a housing including a bottom wall extending between first, second, third and fourth sidewalls to define a cavity that is sized and shaped to receive the electronic device. An accessory receptacle connector is disposed within the housing and defines a receiving opening positioned at an outside surface of the housing and a receiving cavity coupled to the receiving opening. A plug connector is positioned within the cavity at an internal surface of the first sidewall and is configured to be inserted into a corresponding receptacle connector of the electronic device when the electronic device is received within the cavity. A bracket is coupled to the accessory receptacle connector and to the plug connector, the bracket having a curved portion that substantially matches a curvature of the first sidewall and a straight portion that extends substantially parallel to the plug connector. A ground spring is positioned between the accessory receptacle connector and the bracket, the ground spring having at least one spring arm with a distal end that is positioned within the receiving cavity.

In some embodiments the distal end is positioned to contact a plug portion of a mating connector when the plug portion is received within the receiving cavity. In various embodiments a ground path is formed between the plug connector and the plug portion of the mating connector via the ground spring and the bracket. In some embodiments the ground spring is welded to the exterior metallic shell of the accessory receptacle connector and welded to the bracket. In various embodiments the ground spring includes a pair of spring arms, each having a distal end that are positioned within the receiving cavity.

To better understand the nature and advantages of the present invention, reference should be made to the following description and the accompanying figures. It is to be understood, however, that each of the figures is provided for the purpose of illustration only and is not intended as a definition of the limits of the scope of the present invention. Also, as a general rule, and unless it is evident to the contrary from the description, where elements in different figures use identical reference numbers, the elements are generally either identical or at least similar in function or purpose.

DETAILED DESCRIPTION

Some embodiments of the disclosure relate to electronic devices having more than one external electrical connector. In some instances, embodiments of the disclosure are particularly well suited for electronic accessories that have insulative exterior enclosures because of the inability of the exterior enclosure to provide a low-impedance ground path between the exterior electrical connectors, for meeting EMC requirements.

For example, in some embodiments an accessory for an electronic device includes a cavity sized to receive the electronic device. A plug connector is attached to an inside surface of a sidewall of the accessory and is positioned within the cavity to mate with a corresponding receptacle connector of the electronic device when the electronic device is received within the cavity. The accessory may also have an accessory receptacle connector positioned at an exterior surface and configured to couple the accessory to a charger or other electronic device.

A bracket can be attached to the plug connector and to the accessory receptacle connector to provide both an electrical and mechanical connection between the two connectors. A ground spring is disposed between the bracket and the receptacle connector and is configured to make electrical contact with a tab of a corresponding mating connector such that a low-impedance ground path is formed between the mating connector rand the plug connector. The low-impedance ground path can improve electromagnetic compatibility (EMC) performance of the electronic device. This structure may be particularly useful for electronic accessories that have insulative exterior enclosures.

In order to better appreciate the features and aspects of connector assemblies having a low-impedance ground path between two connectors according to the present disclosure, further context for the disclosure is provided in the following section by discussing one particular implementation of an electronic accessory according to embodiments of the present disclosure. These embodiments are for example only and other embodiments can be employed in other electronic accessories and devices such as, but not limited to docking stations, computers, watches, media players and other devices.

Figure 1:
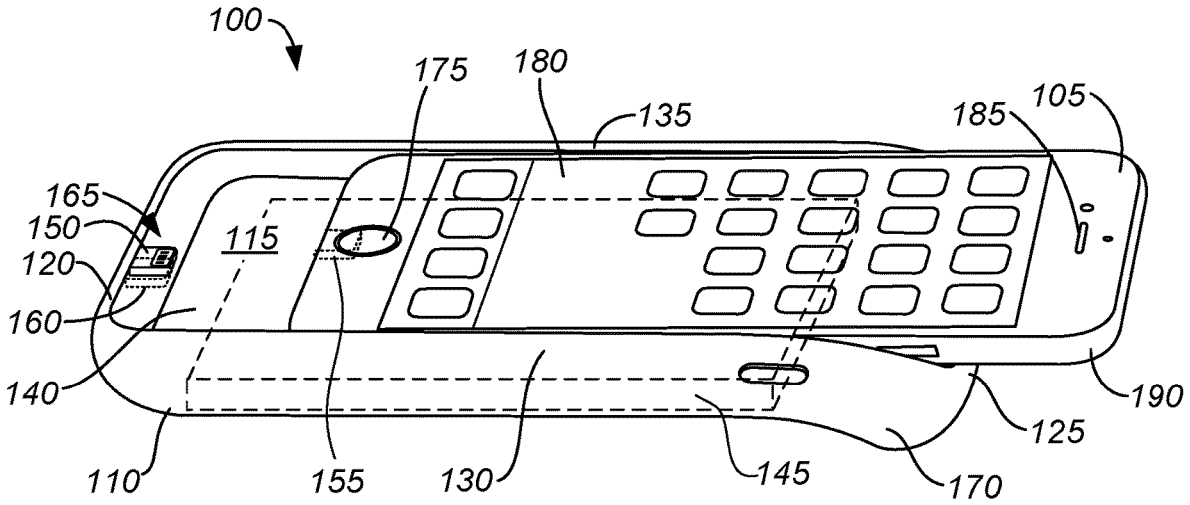
FIG. 1 is simplified perspective view of an accessory in the process of receiving an electronic device, according to an embodiment of the invention.

FIG. 1 illustrates a simplified perspective view of an accessory 100 in the process of receiving an electronic device 105. As shown in FIG. 1, accessory 100 is a smart battery case that includes a housing 110 having a cavity 115 sized and shaped to receive electronic device 105. Cavity 115 is defined by a first sidewall 120 opposite a second sidewall 125, with third and fourth sidewalls 130, 135, respectively, extending therebetween. A bottom wall 140 extends between first, second, third and fourth sidewalls 120, 125, 130, 135, respectively. A rechargeable battery 145 is disposed within accessory 100 and is positioned adjacent bottom wall 140.

A plug connector 150 is positioned at an internal surface of first sidewall 120 of housing 110 and is arranged to be inserted into a corresponding receptacle connector 155 of electronic device 105. An accessory receptacle connector 160 is positioned at an exterior surface of accessory 100 and can be used to couple accessory 100 to a plug connector of another electronic device, such as, for example, a charging adapter. Plug connector 150 and accessory receptacle connector 160 can be part of a connector assembly 165 that provides a resilient low-profile structure that also functions as a low-impedance ground path between the plug connector and accessory receptacle connector to meet EMC requirements, as described in more detail below.

In some embodiments, connector assembly 165 may be particularly beneficial for providing a low-impedance ground path between plug connector 150 and accessory receptacle connector 160 when housing 110 is formed from an electrically insulating material. In some embodiments at least a portion of housing 110 is flexible such as temporarily deflected portion 170, which enables electronic device 105 to be positioned within cavity 115.

In this particular embodiment, electronic device 105 includes a multipurpose button 175 as an input component, a touch screen display 180 as both an input and output component, and a speaker 185 as an output component, all of which are housed within a device housing 190. For simplicity, various internal components, such as the control circuitry, graphics circuitry, bus, memory, storage device and other components are not shown in FIG. 1. Although electronic device 105 is described as one particular electronic device, embodiments of the invention are suitable for use with a multiplicity of electronic devices that interface with an accessory through a mating connector.

Figure 2:
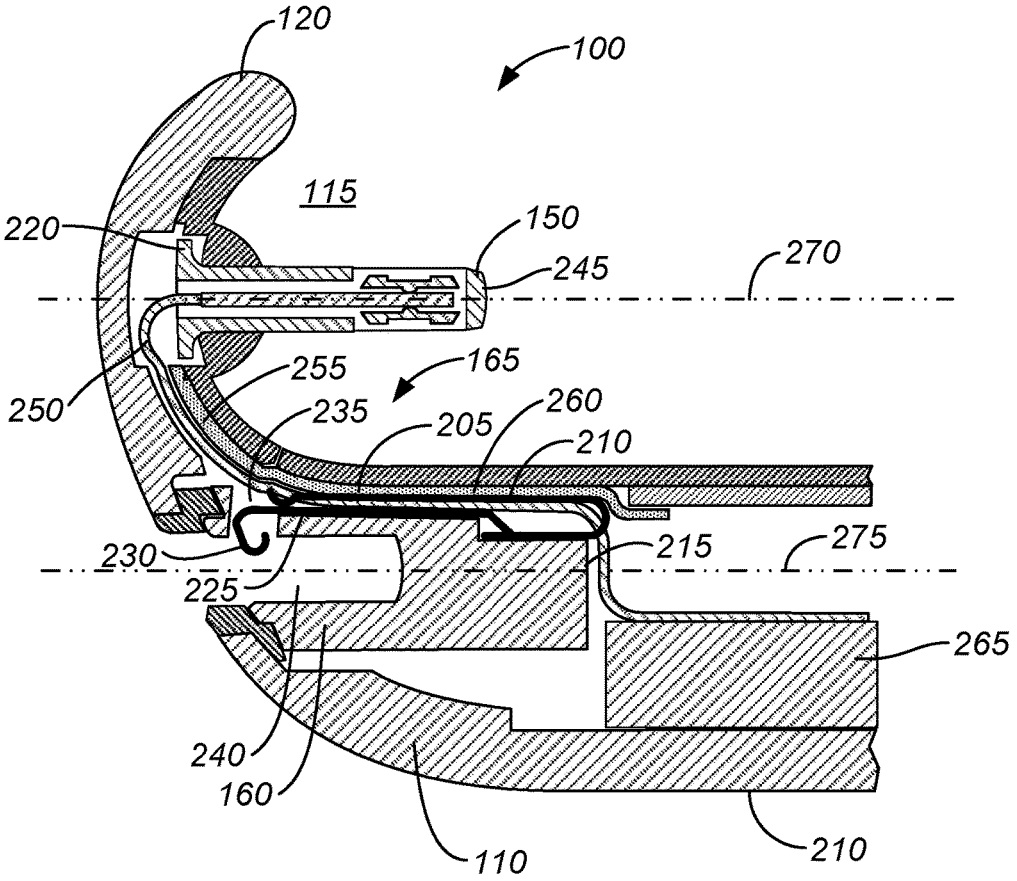
FIG. 2 illustrates a simplified partial cross-sectional view of a connector region of the accessory shown in FIG. 1.

FIG. 2 illustrates a simplified partial cross-sectional view of accessory 100 in the region of plug connector 150 and accessory receptacle connector 160. As shown in FIG. 2, connector assembly 165 includes accessory receptacle connector 160, plug connector 150, bracket 205 and ground spring 210. Bracket 205 electrically and mechanically couples an exterior metallic shell 215 of accessory receptacle connector 160 to an exterior metallic body 220 of plug connector 150. Ground spring 210 is positioned between and electrically coupled to exterior metallic shell 215 of accessory receptacle connector 160 and bracket 205. Ground spring 210 includes a pair of spring arms 225, each having a distal end 230 that protrudes through aperture 235 such that the distal end is positioned within a receiving cavity 240 of the accessory receptacle connector. Distal end 230 is positioned to contact a plug portion of a mating connector (not shown in FIG. 2) when the mating connector is received within receiving cavity 240 such that a low-impedance ground path is formed between the mating plug connector and plug connector 150 via ground spring 210 and bracket 205. In some embodiments a low-impedance ground path between the mating plug connector (not shown in FIG. 2) and plug connector 150 can improve EMC performance of accessory 100.

Plug connector 150 is positioned at an internal surface of first sidewall 120 of housing 110. Connector tab 315 extends from first sidewall 120 to a distal tip 245 and extends in a direction towards second sidewall 125 (see FIG. 1). A flexible electronic circuit 250 extends out of plug connector 150 and is formed along a first portion 255 and a second portion 260 of bracket 205. Flexible electronic circuit 250 is electrically coupled to circuitry 265 within accessory 100 and can be used to couple power and/or data to electronic device 105 (see FIG. 1) including coupling stored power from battery 145 (see FIG. 1) to the electronic device. In some embodiments flexible electronic circuit 250 can be used to communicate bidirectional data and power between electronic device 105 (see FIG. 1), battery 145 (see FIG. 1) and an external device coupled to accessory receptacle connector 160.

The low-profile structure of connector assembly 165 can enable first sidewall 120 of housing 110 to have a relatively thin profile and can be used as a low-impedance path to ground to meet EMC requirements. As further shown in FIG. 2, first portion 255 of bracket 205 follows a curvature of first sidewall 120 of housing 110 and second portion 260 extends adjacent to accessory receptacle connector 160.

The resilient low-profile structure of connector assembly 165 can also enable plug connector 150 and accessory receptacle connector 160 to be mounted in substantially the same vertical plane (e.g., be stacked) as shown in FIG. 2. More specifically, in some embodiments plug connector 150 is positioned in a first plane 270 that is aligned with a length and a width of plug connector 150 (e.g., plane 270 extends perpendicular "out of the paper" to the image in FIG. 2) and is centered within the plug connector, and accessory receptacle connector 160 is positioned in a second plane 275 aligned with a length and a width of the accessory receptacle connector 160 (e.g., plane 275 extends perpendicular "out of the paper" to the image in FIG. 2) and is centered on the receptacle connector. In some embodiments this compact configuration can enable an aesthetically appealing appearance of accessory 100.

Figure 3:
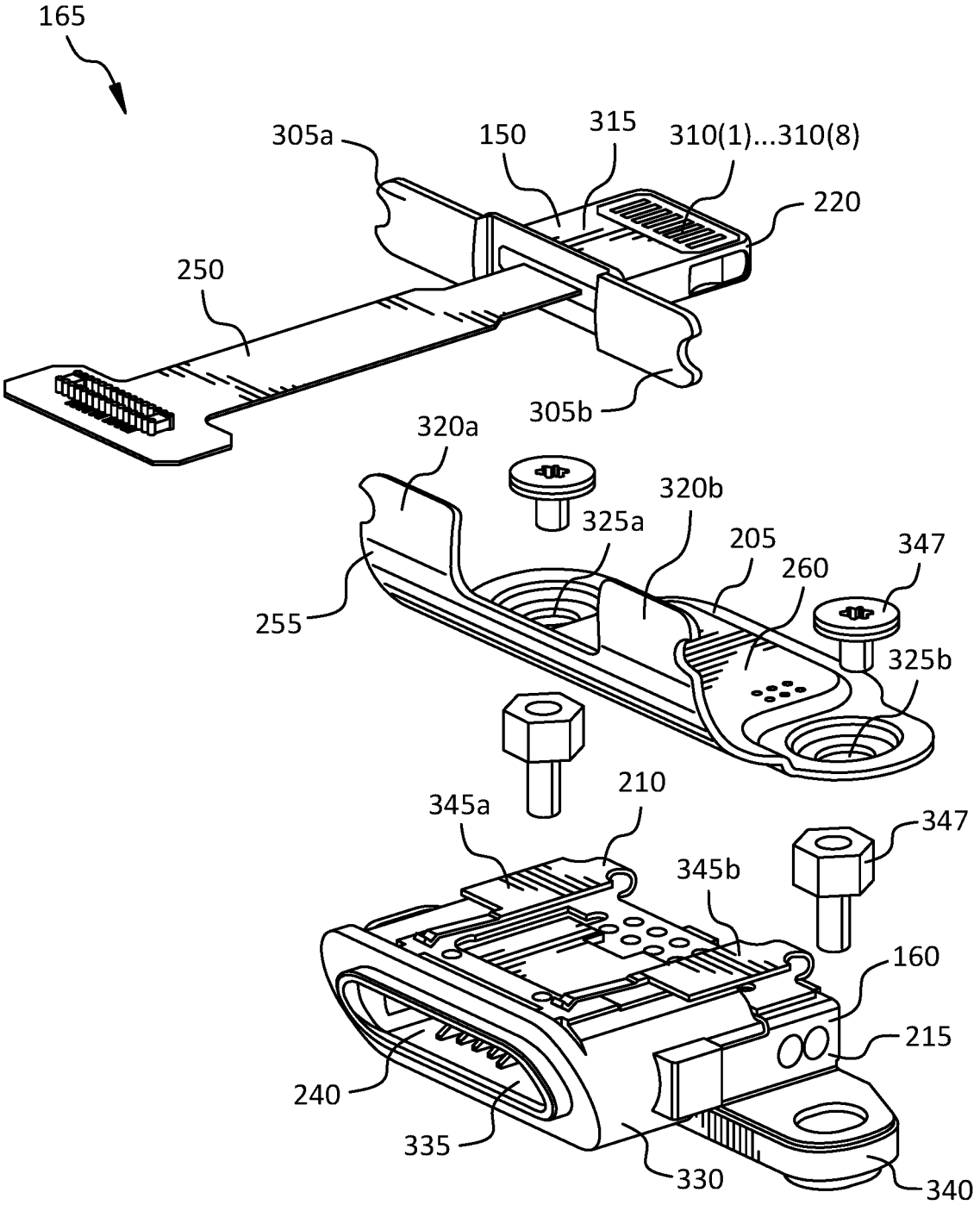
FIG. 3 illustrates a simplified exploded view of the connector assembly used in the accessory shown in FIGS. 1-2.

FIG. 3 illustrates a simplified exploded view of one embodiment of connector assembly 165. As shown in FIG. 3, connector assembly 165 includes plug connector 150, bracket 205, accessory receptacle connector 160 and ground spring 210. Plug connector 150 includes exterior metallic body 220 that generally defines a shape of the plug connector and includes transverse extensions 305*a*, 305*b*. A plurality of electrical contacts 310(1) . . . 310(8) can be used to couple electrical signals to electronic device 105 (see FIG. 1).

In some embodiments, tab 315 of plug connector 150 is between 5-10 millimeters wide and between 1-3 millimeters thick. Also in some embodiments, tab 315 has a length that is greater than its width which is greater than its thickness. In other embodiments, the length and width of tab 315 are within 1.0 and 0.2 millimeters of each other. In one particular embodiment, tab 315 is 6.7 millimeters wide and 1.5 millimeters thick. In other embodiments, tab 315 has the same 6.7 millimeter width and 1.5 millimeter height but a longer length.

In some embodiments bracket 205 is formed in a partially arcuate profile having a first portion 255 that follows a curvature of first sidewall 120 of housing 110 and a second portion 260 that extends adjacent to accessory receptacle connector 160. First portion 255 can include a extensions 320*a*, 320*b* that can be attached to transverse extensions 305*a*, 305*b* and second portion 260 can include mounting holes 325*a*, 325*b*. In some embodiments bracket 205 can be formed from a flexible metal and be attached to plug connector 150 and bracket 205 using laser welding.

In some embodiments accessory receptacle connector 160 includes an enclosure 330 that defines a receiving opening 335 and receiving cavity 240. Enclosure 330 can also define mounting bosses 340 that can be coupled with fasteners 347 to bracket mounting holes 325*a*, 325*b*. Exterior metallic shell 215 can be attached over at least a portion of enclosure 330 and can also extend across mounting bosses 340. In some embodiments enclosure can be made from an insulative plastic and exterior metallic shell 215 can be made from a metal.

In some embodiments ground spring 210 can be attached to exterior metallic shell 215 of accessory receptacle connector 160. Ground spring 210 can also have spring arms (not shown in FIG. 3) with distal ends that protrude through apertures defined by enclosure 330, as described in more detail below. Ground spring 210 can also include upper plates 345*a*, 345*b* that are attached to second portion 260 of bracket 205. In some embodiments ground spring 210 can be made from a flexible metal and can be attached to exterior metallic shell 215 with laser welding and to bracket 205 with blind laser welding.

When fully assembled, connector assembly 165 can form a low impedance ground path between plug connector 150 and the plug portion of a mating connector that is received within receiving cavity 240 of accessory receptacle connector 160. The low-impedance ground path can be formed via the distal ends of the ground spring contacting the plug portion of the mating connector, through the ground spring to the bracket and through the bracket to the exterior metallic shell of the plug connector.

Figure 4:
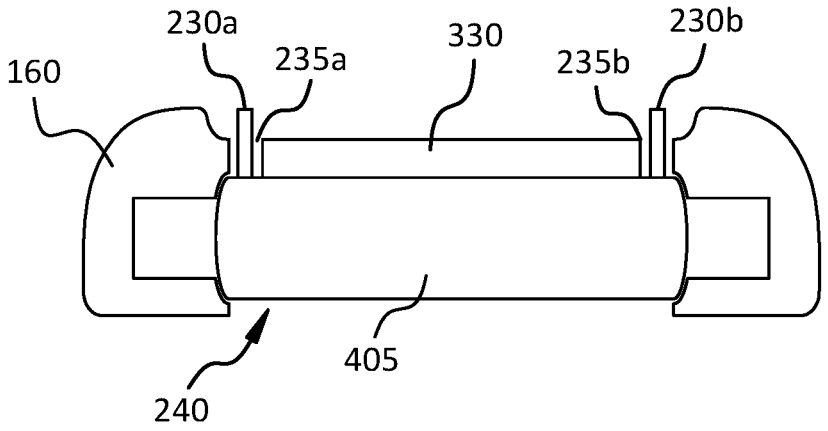
FIG. 4 illustrates a simplified partial cross-sectional view of the receptacle connector shown in FIGS. 1-3 with a mating plug connector positioned within the receiving cavity.

FIG. 4 illustrates a simplified partial cross-sectional view of accessory receptacle connector 160 with a mating plug connector 405 received within receiving cavity 240. As shown in FIG. 4, apertures 235*a*, 235*b* defined by enclosure 330 enable distal ends 230*a*, 230*b* of ground spring 210 to make direct electrical contact with a plug portion of mating plug connector 405.

Figure 5:
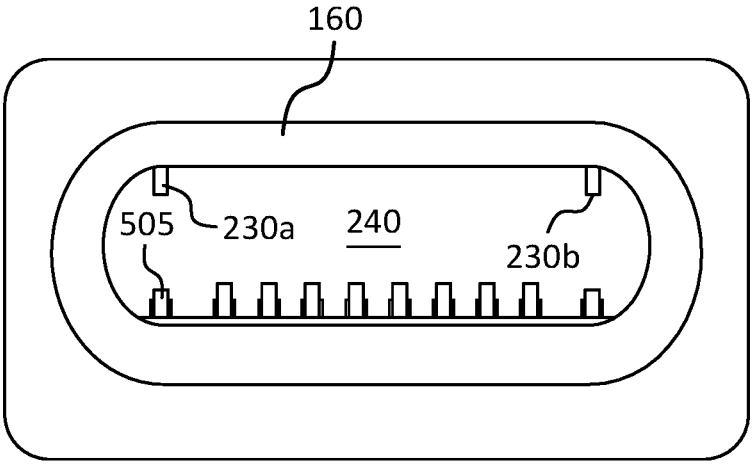
FIG. 5 illustrates a simplified plan view of the receiving cavity of the receptacle connector shown in FIGS. 1-4.

FIG. 5 illustrates a view into receiving cavity 240 of accessory receptacle connector 160. As shown in FIG. 5, distal ends 230*a*, 230*b* of ground spring 210 are positioned within receiving cavity 240 when there is no mating connector mated with the receptacle connector. Opposite of distal ends are a plurality of electrical contacts 505 positioned to make electrical contact with the mating connector.

Figure 6:
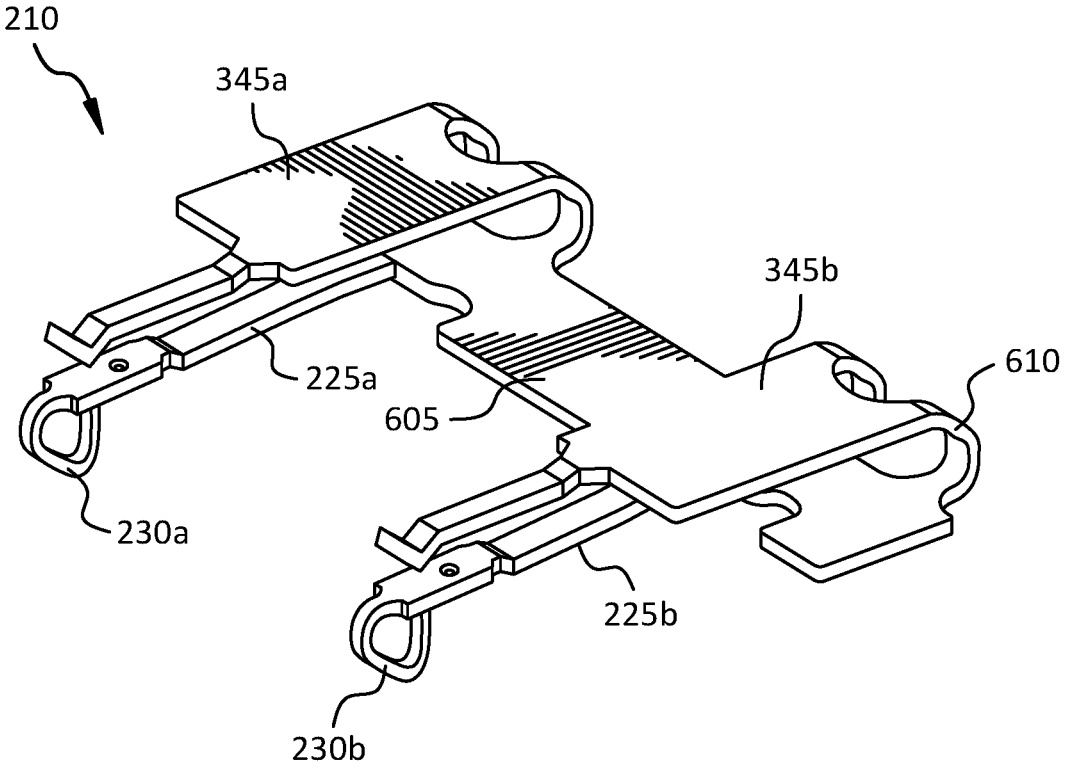
FIG. 6 illustrates a simplified isometric view of the ground spring used in the connector assembly illustrated in FIGS. 1-3.

FIG. 6 illustrates a perspective view of ground spring 210. As shown in FIG. 5, ground spring 210 has a folded geometry with upper plates 345*a*, 345*b* coupled to lower plate 605 via a folded portion 610 having an arcuate shape. Spring arms 225*a*, 225*b* extend from lower plate 605 to respective distal ends 230*a*, 230*b*. Distal ends 230*a*, 230*b* can be formed into an angled contact shape to facilitate installation and removal of a mating plug connector that can cause spring arms to allow distal ends to deflect up and at least partially out of receiving cavity 240 when a mating plug connector is received with in the receiving cavity. Ground spring 210 can be made out of any suitable metal.

Figure 7:
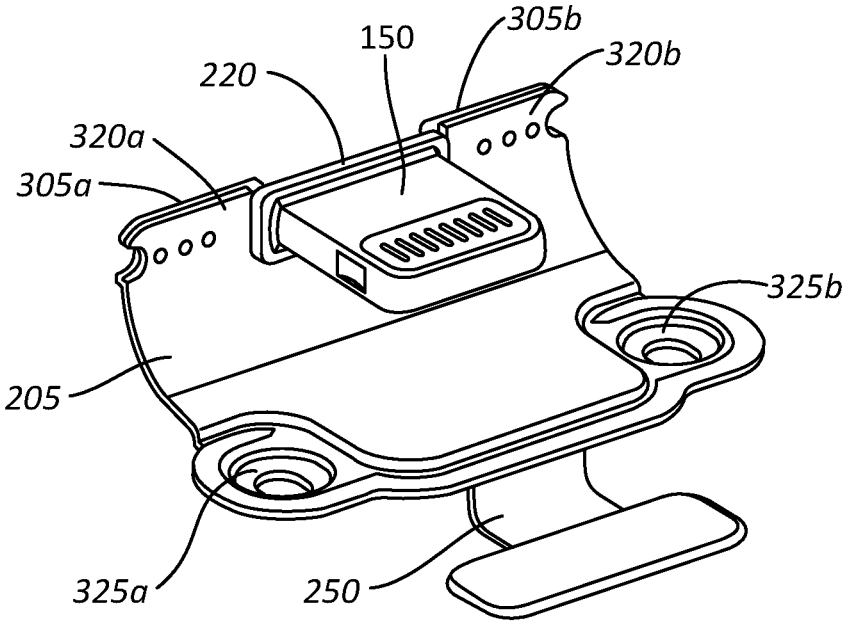
FIG. 7 illustrates a simplified perspective view of a plug connector attached to a bracket of the connector assembly illustrated in FIGS. 1-3.

FIG. 7 illustrates a simplified perspective view of bracket 205 attached to plug connector 150. As shown in FIG. 7, transverse extensions 305*a*, 305*b* are welded to respective extensions 320*a*, 320*b* creating a mechanical and electrical connection between plug connector 150 and bracket 205. In some embodiments a breaking strength of the welds can be designed to be less than a breaking strength of plug connector 150 and/or a corresponding receptacle connector (see FIG. 1). This can enable the weld to function as a safety feature so if a force is applied to connector assembly 165 through electronic device 105 (see FIG. 1) the weld breaks before the electronic device.

Bracket 205 can be formed using stamping, molding or any other suitable process. In some embodiments bracket 205 can be formed from a stainless steel sheet that is between 0.1 millimeters and 0.5 millimeters thick to provide a balance of strength, support, and enough resiliency to allow plug connector 150 to deflect during insertion and removal of electronic device 105. In one embodiment bracket 205 is formed from a sheet that is between 0.2 millimeters and 0.4 millimeters thick. In further embodiments, bracket 205 can be attached to accessory 100 with one or more fasteners (see FIG. 3). In other embodiments bracket 205 can be secured to accessory 100 (see FIG. 1) using adhesive, welding or another bonding process.

Although the embodiments discussed herein use an example axisymmetric plug connector 150, connector assembly 165 can be used with any type of plug or receptacle connectors. For example, in other embodiments connector assembly 165 can include a Universal Serial Bus (USB) connector that can be a Type A, B, C, mini, micro or other type of USB connector. In further embodiments connector assembly 165 can include an RJ-45, HDMI, or other type of connector. One of skill in the art will appreciate that connector assembly 165 can be used with a myriad of connectors (based on an industry standard or proprietary) and the embodiments described herein are not limited to any particular type or configuration of connector.

Although accessory 100 is described as one particular type of electronic accessory, embodiments of the invention are suitable for use with a multiplicity of electronic accessories and devices that include a connector assembly that provides a low-impedance ground path between two connector plugs. For example, any device or accessory that includes two or more connectors can be used with the invention. In some instances, embodiments of the invention are particularly well suited for use with accessories and/or electronic media devices because of their potentially small form factor. As used herein, an electronic media device includes any device with at least one electronic component that may be used to present human-perceivable media. Such devices may include, for example, portable music players (e.g., MP3 devices and Apple's iPod devices), portable video players (e.g., portable DVD players), cellular telephones (e.g., smart telephones such as Apple's iPhone devices), video cameras, digital still cameras, projection systems (e.g., holographic projection systems), gaming systems, PDAs, desktop computers, as well as tablet (e.g., Apple's iPad devices), laptop or other mobile computers. Some of these devices may be configured to provide audio, video or other data or sensory output.

For simplicity, various internal components, such as the control circuitry, graphics circuitry, bus, memory, storage device and other components of the electronic device 105 and accessory 100 are not shown in the figures.

In the foregoing specification, embodiments of the disclosure have been described with reference to numerous specific details that can vary from implementation to implementation. The specification and drawings are, accordingly, to be regarded in an illustrative rather than a restrictive sense. The sole and exclusive indicator of the scope of the disclosure, and what is intended by the applicants to be the scope of the disclosure, is the literal and equivalent scope of the set of claims that issue from this application, in the specific form in which such claims issue, including any subsequent correction. The specific details of particular embodiments can be combined in any suitable manner without departing from the spirit and scope of embodiments of the disclosure.

Additionally, spatially relative terms, such as "bottom or "top" and the like can be used to describe an element and/or feature's relationship to another element(s) and/or feature(s) as, for example, illustrated in the figures. It will be understood that the spatially relative terms are intended to encompass different orientations of the device in use and/or operation in addition to the orientation depicted in the figures. For example, if the device in the figures is turned over, elements described as a "bottom" surface can then be oriented "above" other elements or features. The device can be otherwise oriented (e.g., rotated 90 degrees or at other orientations) and the spatially relative descriptors used herein interpreted accordingly.

What is claimed is:

1. A connector assembly comprising:

a first connector having an exterior metallic shell and a receiving cavity sized to receive a plug portion of a mating connector;

a second connector having an exterior metallic body;

a bracket electrically and mechanically coupling the exterior metallic shell to the exterior metallic body; and a ground spring coupled to the exterior metallic shell and having at least one spring arm with a distal end that is positioned within the receiving cavity.

2. The connector assembly of claim 1 wherein the distal end is positioned to contact the plug portion of the mating connector when the plug portion is received within the receiving cavity.

3. The connector assembly of claim 2 wherein a ground path is formed between the second connector and the plug portion of the mating connector via the ground spring and the bracket.

4. The connector assembly of claim 1 wherein the ground spring is welded to the exterior metallic shell and welded to the bracket.

5. The connector assembly of claim 4 wherein the bracket is welded to the exterior metallic body.

6. The connector assembly of claim 1 wherein the ground spring includes a pair of spring arms, each having a distal end that protrudes through a corresponding aperture defined by the first connector.

7. The connector assembly of claim 1 wherein the second connector is a tab connector.

8. A connector assembly comprising:

a receptacle connector having an insulative enclosure and an exterior metallic shell formed at least partially around an exterior of the enclosure, the enclosure defining a receiving cavity sized to receive a plug portion of a mating connector;

a bracket coupled to the exterior metallic shell; and a ground spring positioned between the exterior metallic shell and the bracket, the ground spring having at least one spring arm with a distal end that protrudes through an aperture defined by the enclosure such that the distal end is positioned within the receiving cavity.

9. The connector assembly of claim 8 further comprising a plug connector having an exterior metallic body that is attached to the bracket.

10. The connector assembly of claim 9 wherein the plug connector includes a pair of transverse extensions that are laser welded to the bracket.

11. The connector assembly of claim 9 wherein the distal end of the at least one spring arm is positioned to contact the plug portion of the mating connector when the plug portion is received within the receiving cavity.

12. The connector assembly of claim 11 wherein a ground path is formed between the plug connector and the plug portion of the mating connector via the ground spring and the bracket.

13. The connector assembly of claim 8 wherein the ground spring is welded to the exterior metallic shell and welded to the bracket.

14. The connector assembly of claim 13 wherein the bracket is welded to an exterior metallic body of a plug connector.

15. The connector assembly of claim 8 wherein the ground spring includes a pair of spring arms, each having a distal end that protrudes through a corresponding aperture defined by the enclosure.

16. An accessory for an electronic device comprising:

a housing including a bottom wall extending between first, second, third and fourth sidewalls to define a cavity that is sized and shaped to receive the electronic device;

an accessory receptacle connector disposed within the housing and defining a receiving opening positioned at an outside surface of the housing and a receiving cavity coupled to the receiving opening;

a plug connector positioned within the cavity at an internal surface of the first sidewall and configured to be inserted into a corresponding receptacle connector of the electronic device when the electronic device is received within the cavity;

a bracket coupled to a metallic shell of the accessory receptacle connector and to a metallic body of the plug connector, the bracket having a curved portion that substantially matches a curvature of the first sidewall and a straight portion that extends substantially parallel to the plug connector; and a ground spring positioned between the accessory receptacle connector and the bracket, the ground spring having at least one spring arm with a distal end that is positioned within the receiving cavity.

17. The accessory of claim 16 wherein the distal end is positioned to contact a plug portion of a mating connector when the plug portion is received within the receiving cavity.

18. The accessory of claim 17 wherein a ground path is formed between the plug connector and the plug portion of the mating connector via the ground spring and the bracket.

19. The accessory of claim 16 wherein the ground spring is welded to the metallic shell of the accessory receptacle connector and welded to the bracket.

20. The accessory of claim 16 wherein the ground spring includes a pair of spring arms, each having a distal end that are positioned within the receiving cavity.

* * * * *